United States Patent [19]

Ichimiya

[11] Patent Number: 4,982,854

[45] Date of Patent: Jan. 8, 1991

[54] BEVERAGE CONTAINER WITH SIPPING TUBE

[75] Inventor: Tuyoshi Ichimiya, Hagi, Japan

[73] Assignee: Kabushikikaisha Matumotoya Shokuhin, Hagi, Japan

[21] Appl. No.: 381,235

[22] Filed: Jul. 18, 1989

[51] Int. Cl.[5] ..... B65D 1/06; B65D 23/08; B65D 25/46

[52] U.S. Cl. ..... 215/1 A; 215/1 C; 215/2; 215/12.1; 220/90.2; 229/103.1; 222/572

[58] Field of Search ..... 215/1 A, 1 C, 2, 6, 215/10, 229, 12.1; 220/90.2, 90.4, 90.6; 229/103.1; 222/538, 572, 566, 573

[56] References Cited

U.S. PATENT DOCUMENTS

| | | | |
|---|---|---|---|
| 2,844,267 | 7/1958 | Petriccione | 215/229 X |
| 3,332,567 | 7/1967 | Pugh, Sr. | 229/103.1 X |
| 3,347,401 | 10/1967 | Nataf | 229/103.1 X |
| 3,349,987 | 10/1967 | Wettzner | 220/90.2 X |
| 3,462,061 | 8/1969 | Shore | 229/103.1 |
| 3,980,210 | 9/1976 | Kligerman | 215/1 A X |
| 4,187,951 | 2/1980 | Cambio, Jr. | 215/6 |
| 4,291,814 | 9/1981 | Conn | 220/90.4 |
| 4,301,926 | 1/1981 | Chung | 229/103.1 X |
| 4,318,403 | 3/1983 | Sneider | 222/538 X |
| 4,448,316 | 5/1984 | Hiroshige | 229/103.1 X |
| 4,573,631 | 3/1986 | Reeves | 220/90.2 X |
| 4,618,515 | 10/1986 | Collette et al. | 215/1 C X |
| 4,830,204 | 5/1989 | Lin | 220/90.2 X |

FOREIGN PATENT DOCUMENTS

| | | | |
|---|---|---|---|
| 2707314 | 11/1978 | Fed. Rep. of Germany | 215/2 |
| 1482875 | 6/1967 | France | 215/10 |
| 95492 | 1/1971 | France | 215/1 C |
| 8504850 | 11/1985 | PCT Int'l Appl. | 220/90.2 |
| 978901 | 1/1965 | United Kingdom | 229/103.1 |

*Primary Examiner*—Sue A. Weaver
*Attorney, Agent, or Firm*—Armstrong, Nikaido, Marmelstein, Kubovcik & Murray

[57] ABSTRACT

A beverage container made of synthetic resin and having a beverage-pouring inlet at a concave section of the container bottom and a sipping tube connected to the container body at the bottom. A middle portion of the sipping tube is provided with a flexional bellows. This beverage container can replace the conventional can because the sipping tube is fitted into a longitudinal groove formed on the container body and the container is totally covered with a thermal-shrinking bag which allows no projections over the container profile.

3 Claims, 2 Drawing Sheets

BEVERAGE CONTAINER WITH SIPPING TUBE

BACKGROUND OF THE INVENTION

The present invention relates to a beverage container made of synthetic resin to contain refreshing beverages (including juices, cola, soda pops, water, etc.).

In recent years, many kinds of refreshing beverages are sold packed in a can, a bottle, or a container made of synthetic resin. The synthetic resin container has been changed in shape from simple one to that provided on its body with a sipping tube having flexional bellows at the middle portion because it is easy to mold and has some extent of flexibility.

In the case of beverage container relating to the conventional art, however, there has been a problem that it is difficult to fill almost thoroughly the container with a refreshing beverage due to the air remaining in the container after pouring the refreshing beverage into the container because, in such case, the inlet to pour the beverage serves for a straw-shaped sipping tube to drink the refreshing beverage.

There has been another problem in the case of above-said beverage container that the refreshing beverage in the container may overflow and soil the clothes when the tip of the sipping tube is opened, because the tip of the sipping tube is thermally sealed after filling the container with a refreshing beverage by pouring it through the sipping tube and, as a result, it is difficult to form the tip into a shape of projection type (spherical one for example) which is easy to open.

Further, in the case of beverage container provided with a sipping tube having bellows in the middle portion as described above-said sipping tube has been obstructive in the distribution and sales processes and, as a result, it has been bent and attached to the container body and fitted to the body with a packing sheet separately prepared. However, in the case of sale by a vending machine, etc., there has been a problem that a part of the bent sipping tube projects and makes the container be caught in the machine.

SUMMARY OF THE INVENTION

The present invention was thought out to overcome above-mentioned difficulties and, accordingly, it is an object of this invention to provide a beverage container, wherein it is possible to pour a refreshing beverage into the container easily, it is possible to make the sipping tube have a construction allowing little overflow of content at the time of opening, and it is further possible to incorporate the sipping tube having bellows at the middle portion so as to form a compact package.

The beverage container relating to the present invention with the object mentioned above comprises a container body which is made of synthetic resin and has a longitudinal groove running from the one side of the body through the center of the top to the other side, a sipping tube which is provided with a constriction in the top portion, bellows in the middle portion, whose bottom end is connected to the bottom section of the container body, and is fitted into the longitudinal groove of said container body, and a beverage-pouring inlet which is disposed at the concave section formed on the bottom of above-said container body and provided with a cover to seal the poured refreshing beverage.

The present invention is also applicable to the container which has a hemispherical top, a reinforcing lateral groove at the middle portion, and an opener at the top portion.

The beverage container relating to the present invention has a beverage-pouring inlet and a sipping tube separately disposed on the container body, and the beverage-pouring inlet is disposed at the concave section of the bottom. As a result, since the sipping tube is not sealed after the container is filled with its content, the tip of the sipping tube can be formed into any shape such as sphere, disk, and projection as well as having a constriction to make it easy to bite the tip off and, accordingly, the sipping tube can easily be opened at the constricted section.

The sipping tube can be bent in any direction because it is provided with bellows in the middle portion and it also can be fitted in a longitudinal groove running from the one side of the body through the center of the top to the other side so that the part of the tube may not project out. As a result, the sipping tube and the beverage-pouring inlet do not project out of the outer surface of the container body and, accordingly, in the case of selling juice, etc. charged in said beverage container, it becomes free from being caught in the machine.

Further, because the bottom end of above-said sipping tube is connected to the bottom of the container body, it becomes possible to drink the content without inclining the container.

BRIEF DESCRIPTION OF THE DRAWINGS

FIG. 5 is a sectional view of said beverage container in upside-down state, FIG. 6 is a side view of said beverage container in the state of being wrapped with a packing sheet.

DETAILED DESCRIPTION OF THE PREFERRED EMBODIMENT

Figure 1:
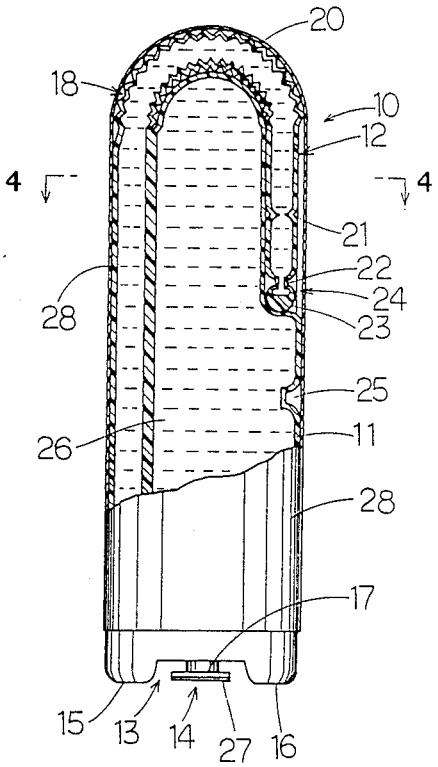
FIG. 1 is a partially cutaway side-sectional view of the beverage container relating to a preferred embodiment of this invention in the state of being wrapped with a packing sheet.

As illustrated in FIGS. 1 through 4, the beverage container 10 relating to one embodiment of the present invention comprises a container body 11 to contain a refreshing beverage, a sipping tube 12 whose bottom end is connected to the bottom section of said container body 11, and a beverage-pouring inlet 14 disposed at the concave section 13 of above-said container body 11. The details of these components are described hereinunder.

Though above-said beverage container 10 is produced by a blow molding (multi-layer blow molding) using a three-layer film comprising an ethylene vinylalcohol copolymerized resin for an interlayer, and polyethylene resin layers sticked on the top and bottom surfaces of the interlayer, a soft or semi-hard snythetic resin however may be used as the material for above-said beverage container 10, and the present invention is also applicable to a molding method other than blow molding (injection molding for example).

Above-said container body 11 is formed into a cylinder having a circular sectional profile, a bottom concave section 13 on the bottom, and a beverage-pouring inlet 14 at the center of said bottom concave section 13. The top face of this beverage-pouring inlet 14 is above the right and left bottom supporting surfaces 15 and 16 of the container body 11 and, as a result, said beverage container 10 stands still because the bottom surface of the container body 11 can contact the floor with its overall area. In addition, there provided a flange 17 on the top of above-said beverage-pouring inlet 14 so that said inlet 14 may be held by a device to pour a refreshing beverage into the container.

Figure 2:
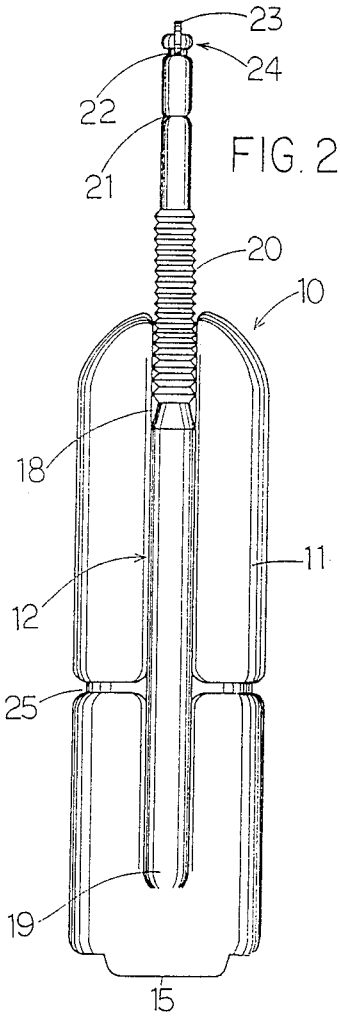
FIG. 2 is a rear view of said beverage container.
Figure 3:
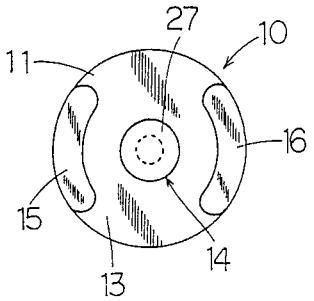
FIG. 3 is a bottom view of the same.
Figure 4:
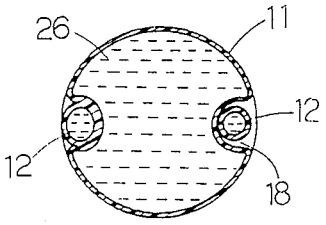
FIG. 4 is a sectional view in the direction of the arrow 4—4 in FIG. 1.
Figure 7:
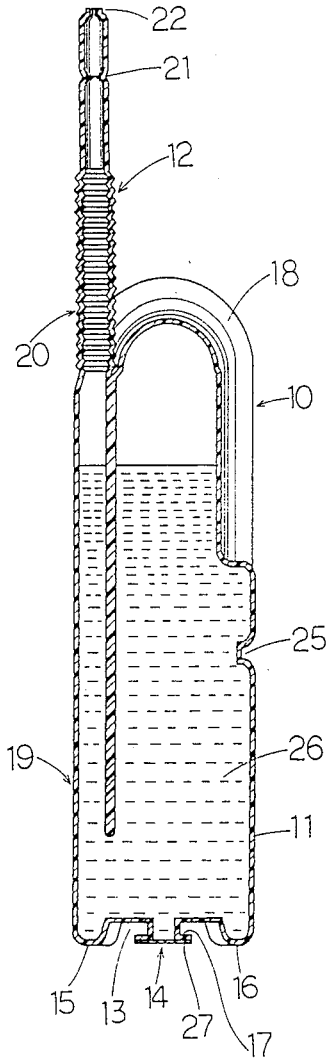
FIG. 7 is a sectional view of said beverage container in the state of being used.

On the side face of above-said container body 11, there formed a longitudinal groove 18 which runs from the one side of the body through the top to the other side as shown in FIGS. 1 and 2 and there provided a sipping tube 12 whose bottom end 19 is connected to the bottom section of the container body 11. This sipping tube 12 is provided with bellows 20 in the middle portion, and the portion below the bellows 20 down to the bottom end 19 is formed into a cylindrical tube and the one side of this tube is firmly integrated into the container body 11 as shown in FIG. 7.

The portion beyond above-said bellows 20 is formed into a cylindrical tube and provided with constrictions 21 and 22 on the way and, at the end section, there provided a projection 24 having a disk 23.

Further, in the middle of above-said container body 11, a reinforcing lateral groove 25 is provided so that the middle portion of the container body 11 may not swell if the container 11 is made of soft synthetic resin.

In the case of using this beverage container 10, said container 10 is first put upside down as shown in FIG. 5 and, keeping the container as it is, the refreshing beverage 26 is poured into the container from bottom (upside in FIG. 5).

In this case, it is preferable to hold the beverage container 10 by securing the flange 17 of the beverage-pouring inlet 14 by use of a U-shape holder inserted from one side (not shown in the drawing), but it is also possible to use a holder into which the container body 11 is fitted together with the sipping tube 12.

In this case, the refreshing beverage 26 is first charged into the container body 11 and, with the rise of its level, the refreshing beverage overflows into the sipping tube 12 and fills the container excepting the space near the bottom faces 15 and 16.

After filling the container, the beverage-pouring inlet 14 is sealed with a cover 27 on its flange 17. The cover 27 is made of aluminum foil and applied with adhesives on its periphery to be sticked to above-said flange 17 in this embodiment, and it is also possible to form the cover with a synthetic resin and bond it thermally to the flange 17.

Then, after said beverage container 10 is put in normal position as shown in FIG. 1, the sipping tube 12 is retracted into the longitudinal groove 18, and then the container body is covered with a thermal-shrinking synthetic resin bag 28, which is heated and shrinks to make a construction not allowing a projection as shown in FIGS. 1 and 6.

To drink the content of this beverage container 10, the outer bag 28 is broken, the sipping tube 12 is pulled out of the longitudinal groove 18 as shown in FIG. 2, the projection 24 is bitten off from the constricted portion 22 at the top end of the sipping tube 12, and then, as shown in FIG. 7, through the sipping tube 12, the refreshing beverage 26 is sucked with the container body 11 being squeezed. It is also possible to drink the refreshing beverage 26 by cutting away the constricted portion 21 as the case may be.

Figure 8:
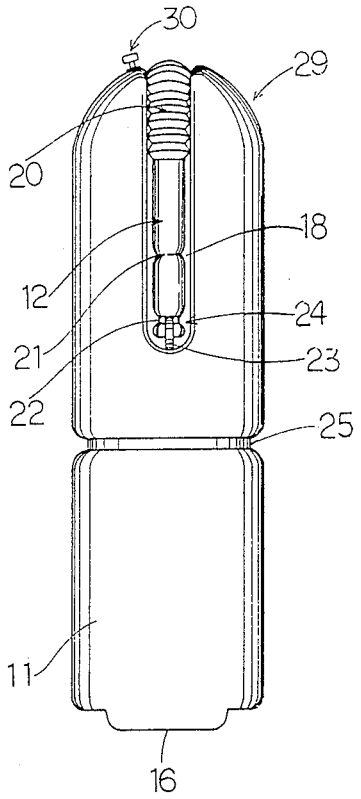
FIG. 8 is a front view of the beverage container relating to another preferred embodiment of this invention.

Then the difference between the beverage container 29 shown in FIG. 8 relating to the second embodiment of this invention and the beverage container 10 relating to above-said first embodiment is described here, and the same components are provided with the same number and the descriptions of these components are omitted.

Figure 9:
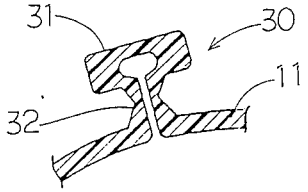
FIG. 9 is an enlarged sectional view of an element of the invention shown by FIG. 8.

As FIG. 8 illustrates, on the top of the beverage container 29, there provided an opener 30. This opener 30 is provided with a knob 31 on the top as shown in FIG. 9 and connected to the container body 11 via a pipe 32 and, by pulling said knob 31-strongly, a vent hole is made on the top of the container body 11 allowing air to come in. Accordingly by making a vent hole at this section, it is possible to drink the refreshing beverage 26 through the sipping tube 12 even if the container body 11 is made of semi-hard synthetic resin.

What is claimed is:

1. A beverage container comprising:

a hollow cylindrical body formed of a synthetic resin material and having a top and a bottom;

supporting surfaces forming a concave section at the center of said bottom;

a longitudinal groove extending from a side surface of said cylindrical body across said top of said cylindrical body;

a beverage inlet disposed inwardly of said supporting surfaces at said concave section formed at the center of said bottom;

a flange formed at the edge of said beverage inlet;

a cover sealing said beverage inlet; and a sipping tube of a size to fit within said groove, said sipping tube having a bottom end open to an interior of said hollow cylindrical body adjacent said bottom, a top portion extending beyond the top of said cylindrical body, a constriction at said top portion of said sipping tube, and a bellows in said sipping tube between said bottom end and said top portion, said sipping tube being folded about said bellows and fitted into said longitudinal groove.

2. The beverage container defined by claim 1 wherein said top of said cylindrical body is in the form of a hemisphere and further including a reinforcing lateral groove at the middle of said cylindrical body.

3. The beverage container defined by claim 1 wherein said top of said cylindrical body is provided with a vent passage closed by a member formed integrally with said body and said member includes means for manually separating it from said top to open said vent passage.

* * * * *